US011507121B2

(12) United States Patent
Phogat et al.

(10) Patent No.: US 11,507,121 B2
(45) Date of Patent: Nov. 22, 2022

(54) RECOVERY MECHANISM DURING AN INPUT OR OUTPUT VOLTAGE FAULT CONDITION FOR A VOLTAGE REGULATOR

(71) Applicant: Texas Instruments Incorporated, Dallas, TX (US)

(72) Inventors: Rohit Phogat, Bengaluru (IN); Ramakrishna Ankamreddi, Bengaluru (IN); Siddhant Rohela, Bengaluru (IN)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 17/128,426

(22) Filed: Dec. 21, 2020

(65) Prior Publication Data

US 2021/0191438 A1 Jun. 24, 2021

(30) Foreign Application Priority Data

Dec. 20, 2019 (IN) ..... 201941053150

(51) Int. Cl.
*G05F 1/569* (2006.01)

(52) U.S. Cl.
CPC ..... *G05F 1/569* (2013.01)

(58) Field of Classification Search
CPC . G05F 1/569; G05F 1/575; G05F 1/61; G05F 1/614; G05F 1/56
See application file for complete search history.

(56) References Cited

U.S. PATENT DOCUMENTS

2002/0140408 A1* 10/2002 Hwang ..... H02M 3/156 323/224
2011/0227542 A1* 9/2011 Akaho ..... H02J 7/045 320/145
2015/0084606 A1* 3/2015 Nakamura ..... H02M 3/156 323/246

* cited by examiner

*Primary Examiner* — Nguyen Tran

(74) *Attorney, Agent, or Firm* — Charles A. Brill; Frank D. Cimino

(57) ABSTRACT

A circuit includes a reference voltage generator circuit and a regulation loop circuit having an output voltage terminal. The regulator circuit further includes a fault detection circuit having a first input terminal coupled to the output voltage regulator terminal of the regulation loop circuit. The fault detection circuit asserts, on an output terminal of the fault detection circuit, a fault flag signal responsive to a voltage on the first input terminal falling below a first threshold. A programmable filter is coupled between the reference voltage generator circuit and the regulation loop circuit and is coupled to the fault detection circuit. The programmable filter has a programmable time constant. The programmable filter responds to an assertion of the fault flag signal by decreasing the time constant.

22 Claims, 13 Drawing Sheets

RECOVERY MECHANISM DURING AN INPUT OR OUTPUT VOLTAGE FAULT CONDITION FOR A VOLTAGE REGULATOR

CROSS-REFERENCE TO RELATED APPLICATIONS

This application claims priority to India Provisional Application No. 201941053150, filed Dec. 20, 2019, which is hereby incorporated by reference.

BACKGROUND

One type of voltage regulator is a low drop-out (LDO) voltage regulator. Some LDO voltage regulators include an error amplifier that amplifies the difference between a reference voltage (which itself is generated by a separate error amplifier) and an output voltage from the regulator to thereby generate an error signal. The error amplifier continuously generates the output error signal which is used to adjust the gate-to-source voltage (VGS) of a transistor (sometimes referred to as a pass-FET (field effect transistor)) to modulate the current to a bad powered by the regulator, thereby regulating the output voltage.

Some LDO voltage regulators include a reference voltage generator circuit that can scale (up or down) the magnitude of the reference voltage commensurate with the intended magnitude for the output voltage. The reference voltage may have noise superimposed on it due to noise generated by, for example, a bandgap voltage source and a separate error amplifier (separate from the error amplifier that controls the pass-FET) used to generate the scaled reference voltage. As the reference voltage is increased, the magnitude of the reference voltage's noise also increases. Because of reference voltage noise, some LDO voltage regulators include a low-pass filter to attenuate the noise. The bandwidth of the low-pass filter is fairly small. In one example, the 3-dB roll-off frequency for the low-pass filter is 1 Hz.

SUMMARY

In one example, a circuit includes a reference voltage generator circuit and a regulation loop circuit having an output voltage terminal. The regulator circuit further includes a fault detection circuit having a first input terminal coupled to the output voltage regulator terminal of the regulation loop circuit. The fault detection circuit asserts, on an output terminal of the fault detection circuit, a fault flag signal responsive to a voltage on the first input terminal falling below a first threshold. A programmable filter is coupled between the reference voltage generator circuit and the regulation loop circuit and is coupled to the fault detection circuit. The programmable filter has a configurable time constant. The programmable filter responds to an assertion of the fault flag signal by decreasing the time constant.

BRIEF DESCRIPTION OF THE DRAWINGS

For a detailed description of various examples, reference will now be made to the accompanying drawings in which.

DETAILED DESCRIPTION

Figure 1:
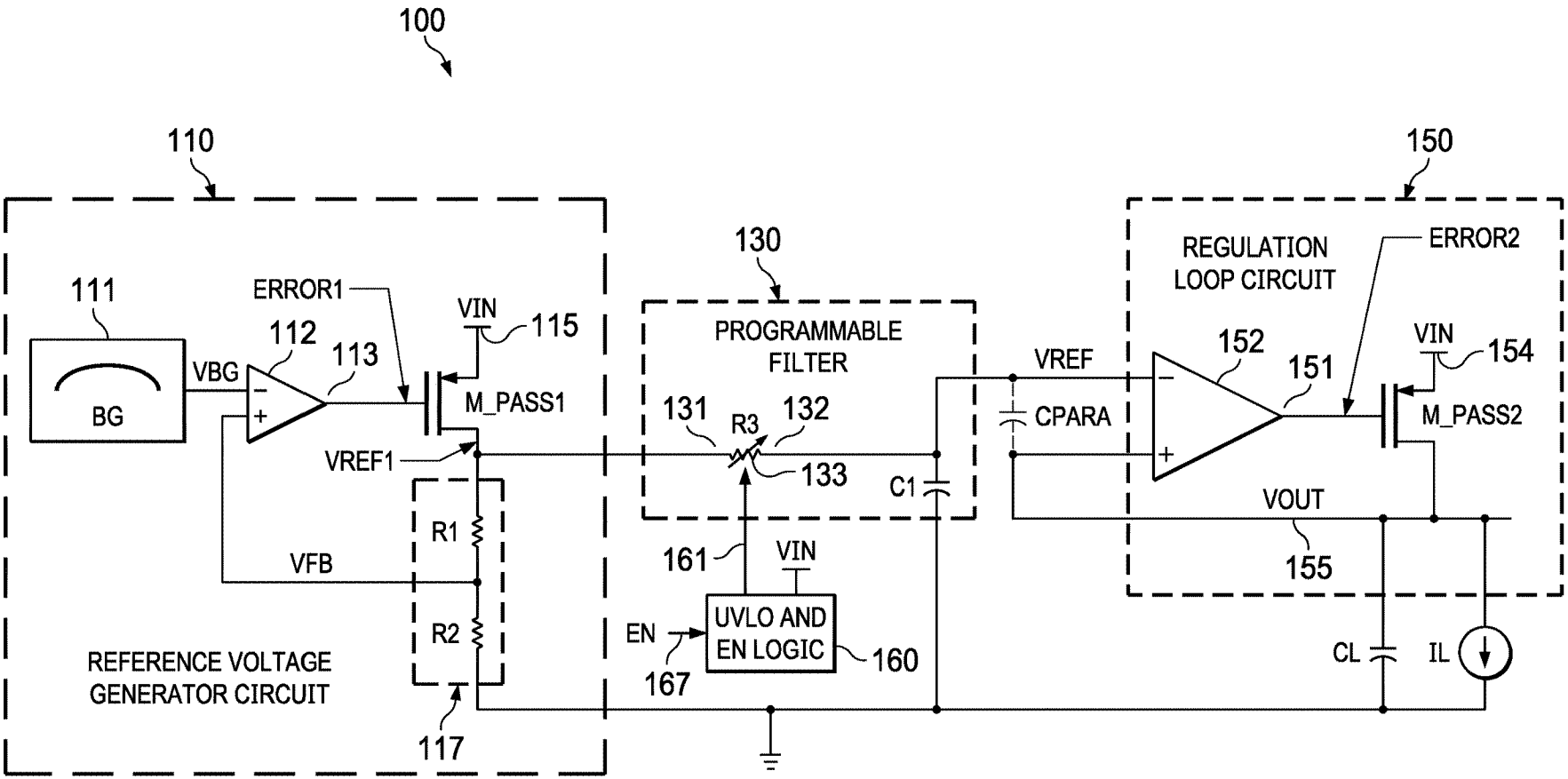
FIG. 1 shows an example implementation of a voltage regulator circuit.

FIG. 1 shows an example of a voltage regulator circuit 100. The voltage regulator circuit 100 includes a reference voltage generator circuit 110, a programmable filter 130, and a regulation loop circuit 150. The reference voltage generator circuit 110 includes an input supply voltage terminal 115 which receives an input supply voltage (VIN). The reference voltage generator circuit 110 generates a reference voltage, VREF1, which is then filtered by programmable filter 130 to produce a filtered reference voltage, VREF. The filtered reference voltage VREF is provided to the regulation loop circuit 150. The regulation loop circuit 150 includes an output voltage terminal 155 on which the regulation loop circuit 150 generates a regulated output voltage, VOUT.

The reference voltage generator circuit 110 includes a bandgap voltage source 111 which produces a bandgap voltage (VBG), a first error amplifier 112, a transistor M_PASS1, and resistors R1 and R2. A bandgap voltage source is a temperature independent voltage reference circuit that produces a fixed voltage regardless of power supply variations, temperature changes and circuit loading from a device. A Brokaw bandgap reference circuit is one such circuit. Transistor M_PASS1 is implemented in this example as a p-type metal oxide semiconductor field effect transistor (PFET transistor) having a gate, a source, and a drain. The voltage on the drain of M_PASS1 is VREF1. Resistors R1 and R2 are connected in series between the drain of M_PASS1 and ground. The series combination of R1 and R2 forms a voltage divider 117 to generate a feedback voltage, VFB, which is proportional to VREF1. The feedback voltage VFB is coupled to a positive input of the error amplifier 112 in this example. The bandgap voltage source 111 is coupled to the negative input of the error amplifier 112. The error amplifier 112 generates an error signal, ERROR1, on the output of the error amplifier 112 which is coupled to the gate of M_PASS1. The error amplifier 112, M_PASS1, and the voltage divider of R1 and R2 form a control loop. The error amplifier 112 amplifies the difference between VFB (derived from VREF1) and VBG (produced by the bandgap voltage source 111) to generate error signal ERROR1. Responsive to VFB being larger than VBG, ERROR1 will increase, and responsive to VFB being smaller than VBG, ERROR1 will decrease.

A decrease in VFB will cause a decrease in the voltage level of ERROR1 thereby causing an increase in the VGS of M_PASS1. An increase in the VGS of M_PASS1 causes an increase in the drain current through M_PASS1 and thus an increase in the current to the voltage divider 117, thereby increasing VREF1. Conversely, an increase in VFB will cause an increase in the voltage level of ERROR1 thereby causing a decrease in the VGS of M_PASS1. A decrease in the VGS of M_PASS1 causes a decrease in the drain current through M_PASS1 and thus a decrease in the current to the voltage divider of R1 and R2, thereby decreasing VREF1. VREF1 is regulated in this manner.

The control loop formed by the error amplifier 112, M_PASS1, and the voltage divider of R1 and R2 helps to sure that VFB will be approximately equal to VBG from the bandgap voltage source 111. The voltage level of VREF1 can be scaled up and down by modulating the resistance of resistor R1 in the voltage divider 117. Resistor R1 may be implemented as a resistor ladder and a corresponding digital switch for each resistive branch of the ladder. The digital switches can be opened or closed by values stored in a storage device (e.g., read only memory) that itself is programmed during manufacturing. For a given current through the voltage divider 117 and with a fixed R2 resistance, an increase in the resistance of R1 will result in an increase in the voltage of VREF1, while a decrease in the resistance of R1 will result in a decrease in the value of VREF1.

The programmable filter 130 includes a programmable resistor R3 coupled to a capacitor C1 to thereby form an RC-based low-pass filter. The programmable resistor R3 has terminals 131, 132, and 133. Terminal 131 is coupled to the drain of M_PASS1 and thus receives VREF1 from the reference voltage generator circuit 110. Terminal 132 is coupled to C1 and provides a filtered version of VREF1 (labeled as VREF) to the regulation loop circuit 150. Terminal 133 is a control input of the programmable resistor R3 and can be used to set the resistance of R3. In one example the programmable resistor R3 comprises a resistor network with switches that can be opened or closed to configure the resistor network for a target resistance. Other implementations for programmable resistors are possible as well.

The regulation loop circuit 150 comprises a second error amplifier 152 coupled to transistor M_PASS2. Like M_PASS1, M_PASS2 also may be implemented as a PFET transistor having a gate, a source, and a drain. The output 151 of error amplifier 152 is coupled to the gate of M_PASS2. The source of M_PASS2 is coupled to a terminal 154 which receives VIN. The drain of M_PASS2 is the output voltage terminal 155 of the voltage regulator circuit 100 and provides the regulated output voltage VOUT to any load connected thereto. In FIG. 1, the load current is shown as IL. Capacitor CL may be included to help ensure the stable operation of the LDO. The capacitance CPARA represents the parasitic capacitance of the input of the error amplifier 152.

The output voltage terminal 155 is coupled to the positive input of error amplifier 152 as a feedback signal. The filtered reference voltage VREF is coupled to the negative input of the error amplifier 152. The error amplifier 152 amplifies the difference between VREF and VOUT to generate an error signal, ERROR2, which is then used to drive the gate of M_PASS2. Responsive to VOUT increasing, ERROR2 will increase, and responsive to VOUT decreasing, ERROR2 will decrease. An increase in VOUT will cause an increase in the voltage level of ERROR2 thereby causing a decrease in the VGS of M_PASS2. A decrease in the VGS of M_PASS2 causes a decrease in the drain current through M_PASS2 and thus a decrease in the load current IL to the load thereby decreasing VOUT. Conversely, a decrease in VOUT will cause a decrease in the voltage level of ERROR2 thereby causing an increase in the VGS of M_PASS2. An increase in the VGS of M_PASS2 causes an increase in the drain current through M_PASS2 and thus an increase in the load current IL thereby increasing VOUT. VOUT is regulated in this manner.

Voltage regulators are designed for a particular range of VIN. VIN must be within the specified range for the voltage regulator to adequately regulate VOUT to its target level. During run-time when VIN is within the specified operational range, the effective resistance of programmable resistor R3 (i.e., the resistance between its terminals 131 and 132) is configured for a resistance large enough that the 3-dB cutoff frequency is relatively low (e.g., 1 Hz). Setting the 3-dB cutoff frequency at a relatively low frequency (for adequate filtering of the aforementioned noise) means that the RC time constant of the programmable filter 130 is relatively high.

FIG. 1 also shows undervoltage lock-out (UVLO) and enable (EN) logic 160, which detects and responds to two conditions. During a power cycle (e.g., power on event), the UVLO and EN logic 160 asserts a control signal 161 to the programmable resistor R3 to configure its resistance for a smaller effective resistance between its terminals 131 and 132 to thereby increase the 3-dB cutoff frequency of the programmable filter 130. Increasing the 3-dB cutoff frequency means that the RC time constant is decreased. As a result, upon VIN returning to its nominal level (within the specified range for normal operation), VREF will return more quickly to its nominal level compared to what would have been the case had the resistance of programmable resistor R3 not been decreased. Upon or shortly after VIN returning to its nominal level, UVLO and EN logic 160 re-programs the programmable resistor R3 for normal operation, that is, the resistance of R3 is increased to result in a 3-dB cutoff frequency of, for example, 1 Hz.

The UVLO and EN logic 160 monitors an enable (EN) signal 167. The EN signal 167 enables and disables the voltage regulator circuit 100. The EN signal is, in some examples, an externally-provided signal (external to the integrated circuit containing the voltage regulator circuit 100). The UVLO and EN logic 160 may include a digital inverter or Schmitt trigger circuit to identify that the EN signal 167 has a rising or falling edge. When the voltage level on the EN signal 167 is lower than a pre-defined enable threshold, the LDO will be turned or maintained off by the UVLO and EN logic 160. The UVLO and EN logic 160 includes a comparator to determine when the EN signal 167 falls below the enable threshold. Responsive to the EN signal 167 falling below the enable threshold, the UVLO and EN logic 160 configures R3 for a smaller resistance so that, as described herein, the voltage regulator 100 can more quickly return to normal operation when the enable signal 167 again recovers to a normal operating level.

The UVLO and EN logic 160 also monitors VIN for a UVLO threshold. The UVLO threshold is a voltage lower than the nominal range of VIN and represents a level below which the voltage regulator 100 cannot adequately power internal circuitry of the voltage regulator. The UVLO and EN logic 160 includes a comparator to determine when VIN drops below the UVLO threshold. Responsive to VIN dropping below the UVLO threshold, the UVLO and EN logic 160 configures R3 for a smaller resistance so that, as explained above, the voltage regulator 100 can more quickly return to normal operation when VIN again recovers to a normal operating level. In one example, VOUT is 5 V and the drop-out voltage is 300 mV. The drop-out voltage is the headroom voltage above the target output regulated voltage VOUT that VIN must maintain. For VOUT equal to, for example, 5 V and with a 100 mV drop-out voltage, VIN must be at least 5.1 V (e.g., 5.1 V to 10 V) in such an example. In one example, the UVLO threshold is 1.6 V.

A brown-out event is an event in which VIN decreases below the minimum level of its target normal operating range but remains higher than the UVLO threshold. In the example of VOUT being 5 V, the UVLO threshold being 1.6 V, and a drop-out voltage of 100 mV, a brown-out event would be characterized by VIN being between 1.6 V and 5.1 V. In this latter range, VIN is not so low as to trigger a UVLO response by the UVLO and EN logic 160. Accordingly, the frequency response or time constant of the programmable filter 130 is not modified in the example of FIG. 1 during a brown-out event, and thus the filter's time constant remains relatively large (e.g., 1 second). Accordingly, when VIN recovers to 3.3V or higher, the filtered reference voltage VREF takes a relatively long period of time to recover.

Figure 2:
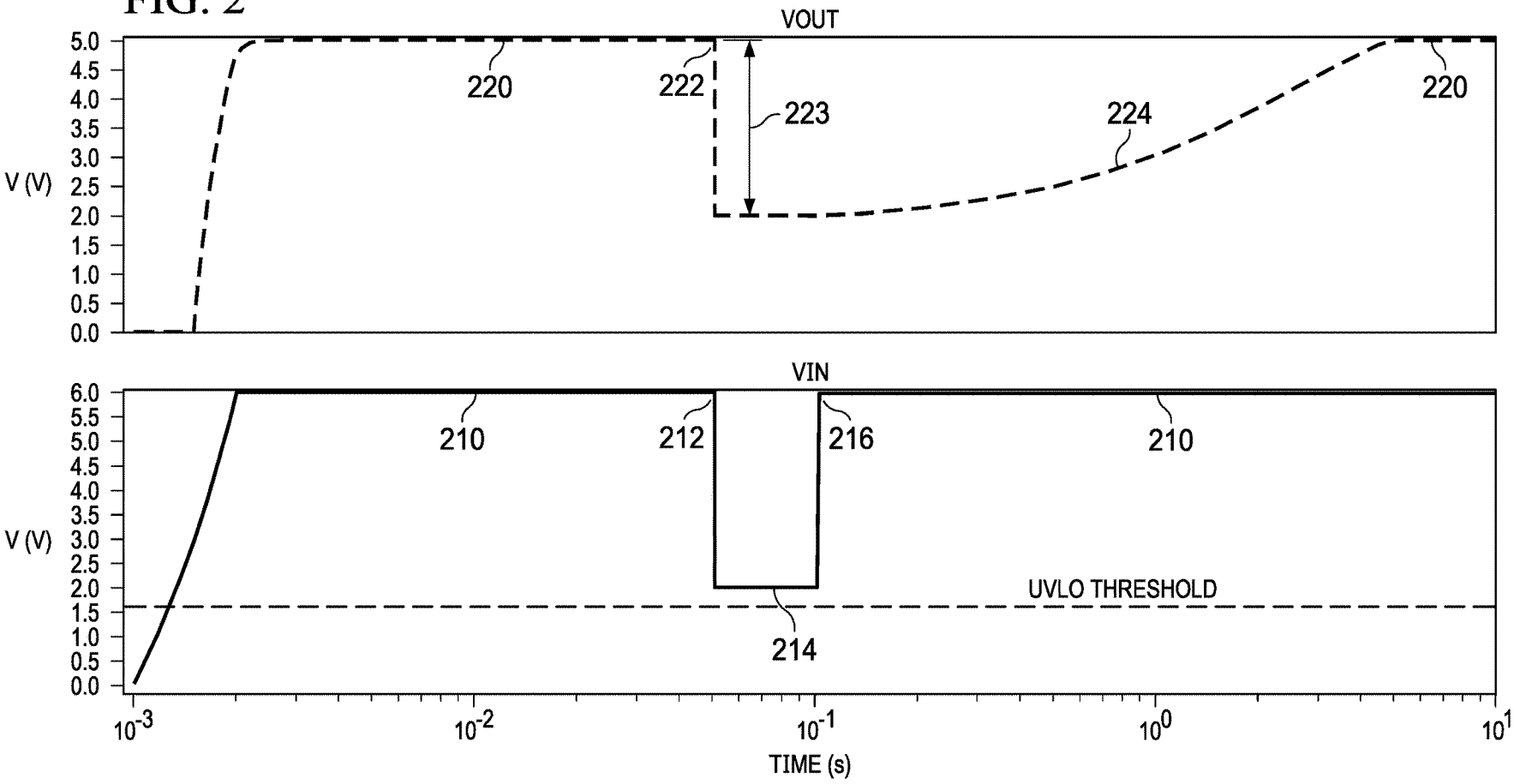
FIG. 2 shows an example signal diagram illustrating the relatively slow response of the output voltage of the voltage regulator circuit of FIG. 1 due to a brown-out event in which the input voltage decreases.

The brown-out effect is illustrated in FIG. 2. VIN is at a nominal level 210 (e.g., 6 V) and VOUT is at a regulated level of 5 V as shown at 220. A brown-out event begins at 212 at which VIN drops to a level 214 (e.g., 2 V). The VIN voltage level at level 214 (2 V) is below its minimum nominal value of 5.1 V (assuming a drop-out voltage of 100 mV) but is above the UVLO threshold of 1.6 V. Upon VIN dropping at 212 to level 214, VOUT also drops at 222 to a voltage approximately equal to the level 214 of VIN. With VIN being that low, the error amplifier 112 within the reference voltage generator circuit 110 decreases ERROR1 low enough to fully turn on M_PASS1. Accordingly, the drain-to-source voltage (VDS) of M_PASS1 will be relatively small and the VREF1 and VREF will approximately equal VIN. With the regulation loop circuit 150 configured for unity gain, VOUT will be equal to VREF and thus approximately equal to VIN as well.

At 216, the brown-out event ends and VIN quickly returns to its previous level 210 (e.g., 6 V). However, because VIN did not drop below the UVLO threshold, the configuration of the programmable filter 130 (i.e., its 3-dB cutoff frequency and time constant) did not change. Accordingly, the recovery of the filtered reference voltage (VREF) relatively slowly increases and thus VOUT also slowly increases as shown in FIG. 2. In one example, the slow increase of VOUT may take approximately 3 seconds to return to its level 220 (e.g., 5 V) when the brown-out event ends.

Figure 3:
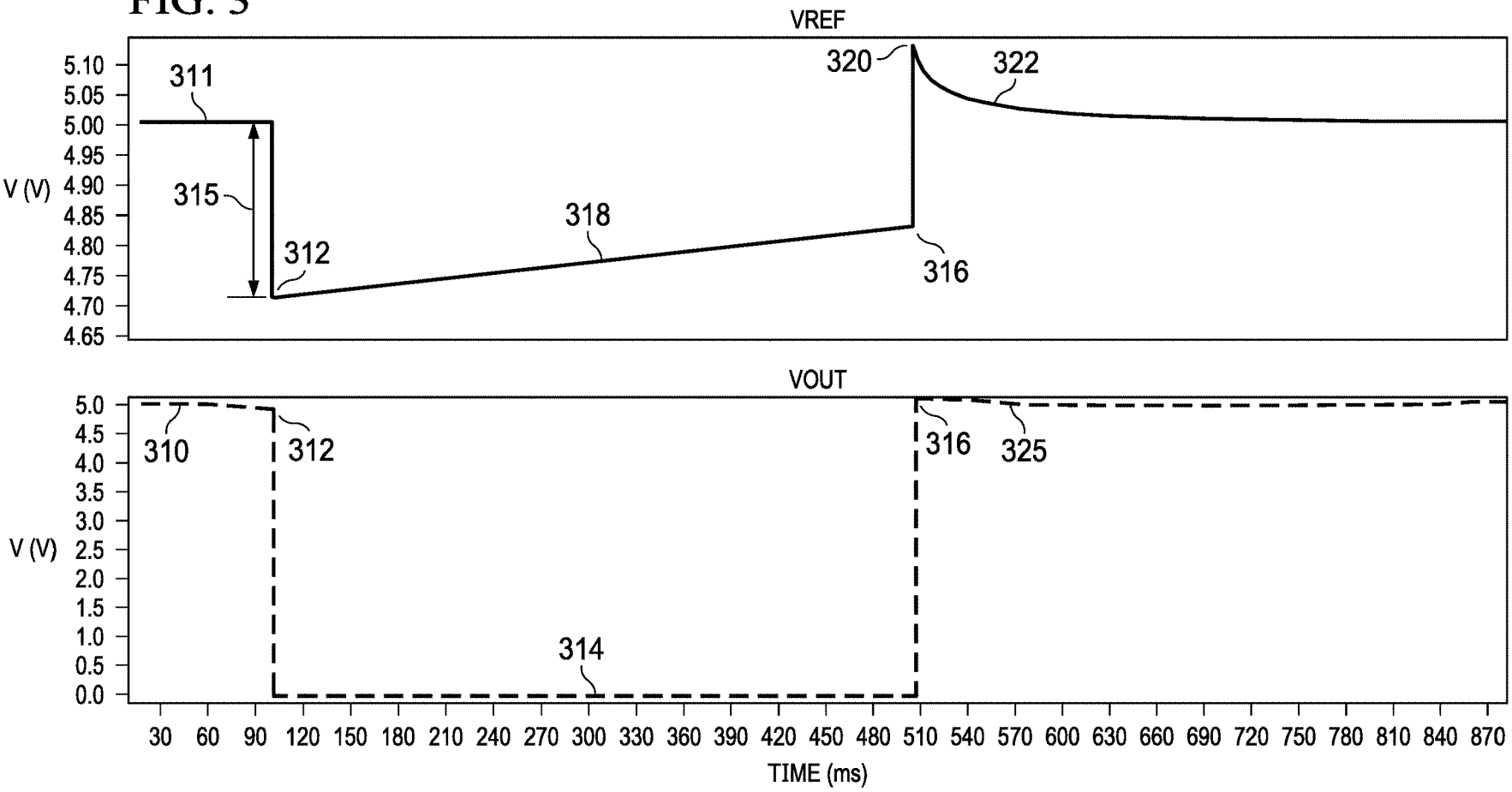
FIG. 3 shows an example signal diagram illustrating the relatively slow response of the filtered reference voltage of the voltage regulator circuit of FIG. 1 due to a temporary short to ground of the output voltage.

FIG. 3 shows the response of the filtered reference voltage (VREF) upon the temporary short to ground of VOUT. Although VOUT should never short to ground, VOUT being temporarily grounded nevertheless may occur due to a fault condition that can happen on a load connected to the voltage regulator's output. FIG. 3 illustrates VOUT being at its nominal, regulated level 310 (e.g., 5 V) and a short on VOUT occurs at 312 forcing VOUT to be at or near 0 V at 314. The inadvertent short condition ends at 316. With VOUT being forced to ground, or nearly ground, at 312, VREF is also forced to decrease from its nominal level at 311. The amount of the decrease is shown by 315. The decrease in VREF stems from the parasitic capacitance (CPARA) coupling of VOUT to VREF and thereby forcing VREF to decrease. After the quick transient event of VOUT forced to ground to (314), VREF slowly ramps up as shown at 318 due to the charging of capacitors C1 and CPARA by current flowing in M_PASS1 present in reference voltage generator circuit.

Upon the short circuit condition of VOUT ending at 316, VREF overshoots rapidly as shown to voltage level 320. The overshoot of VREF is due to the output of the voltage of the regulator circuit (drain of M_PASS2) quickly charging back to its regulated level. This quick charge of the output couples to the filtered reference terminal (negative input of error amplifier 152) through CPARA and charges up higher than the required level. The change in the reference voltage VREF further pushes the output voltage to modulate slightly. After this transient event, the filtered reference VREF begins to discharge as shown at 322 to its nominal value based on the time constant of the programmable filter 130. The time constant is relatively large and accordingly the VREF decays slowly as shown. Because VREF experienced an overshoot and then slow decay back to its nominal value, VOUT also slowly decays back to its nominal value as shown at 325. Due to the programmable filter 130 configured for a fairly large time constant during normal operation, a brown-out condition of VIN (which remains above the UVLO threshold) or a short of VOUT will result in VOUT taking an undesirable amount of time to recover following the end of the brown-out or short-circuit conditions.

Figure 4:
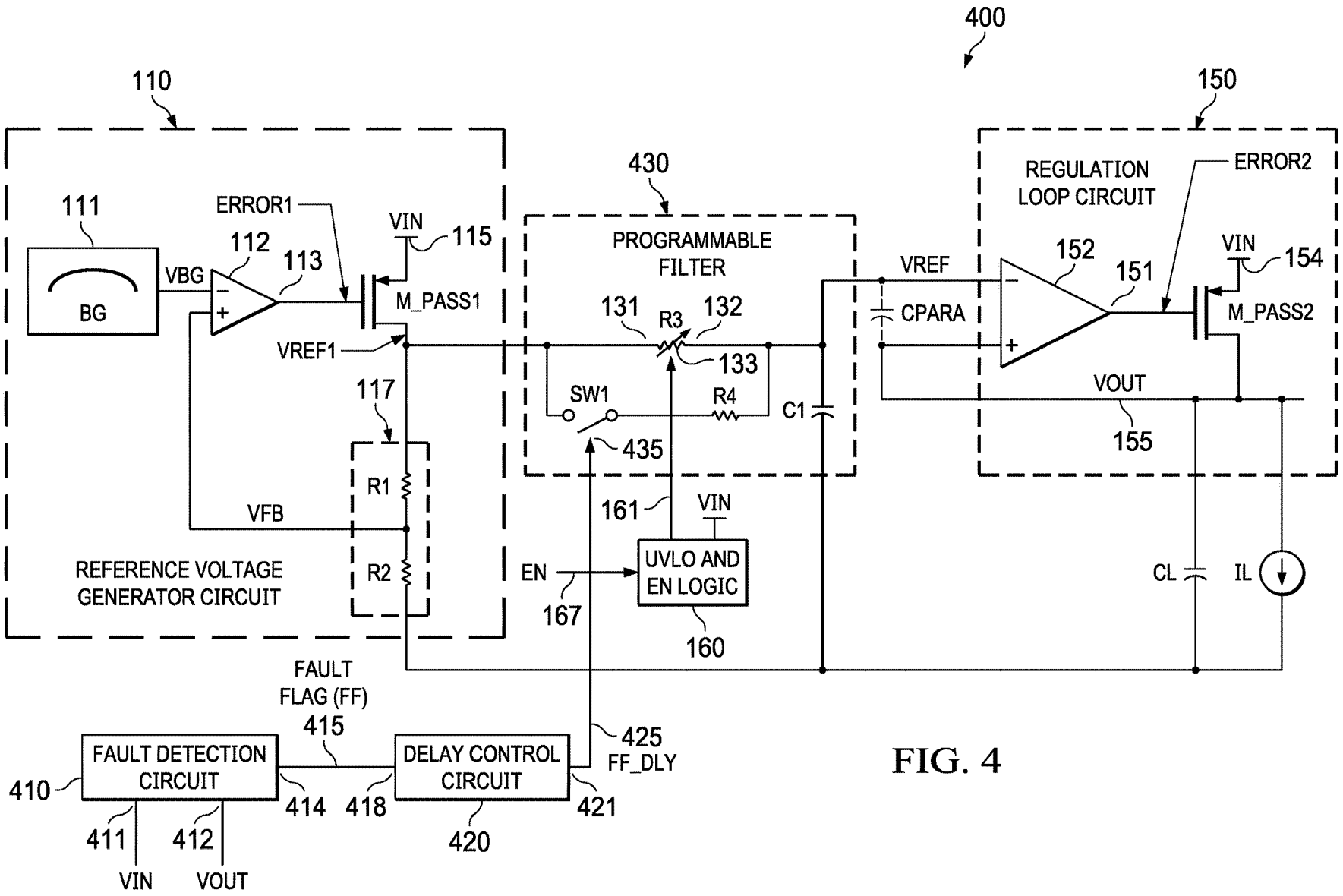
FIG. 4 shows another example implementation of a voltage regulator circuit.

FIG. 4 shows an example of a voltage regulator 400 that address the issues described above regarding the voltage regulator 100 of FIG. 1. The architecture of voltage regulator 400 is similar to the architecture of voltage regulator 100. For instance, voltage regulator 400 includes the reference voltage generator circuit 110 and the regulation loop circuit 150 and a description of the constituent components is not repeated here. The voltage regulator 400 includes a programmable filter 430 coupled between the reference voltage generator circuit 110 and the regulation loop circuit 150. As explained herein, the programmable filter 430 implements a configurable time constant. The voltage regulator 400 also includes a fault detection circuit 410 and a delay control circuit 420.

The programmable filter 430 includes programmable resistor R3 coupled to capacitor C1 as described above, but also includes a switch SW1 coupled in series with a resistor R4. The series combination of switch SW1 and resistor R4 is coupled in parallel with programmable resistor R3. When switch SW1 is closed, resistor R4 is in parallel with programmable resistor R3. In one example, the resistance of resistor R4 is substantially smaller than the resistance of programmable resistor R3. Accordingly, with switch SW1 closed, the effective resistance of the parallel combination of resistors R3 and R4 is close to, but below the resistance of R4. The change in the effective resistance of the programmable filter 430 from a larger resistance to, upon closure of switch SW1, a smaller resistance causes the 3-dB cutoff frequency of the filter to increase thereby reducing the associated time constant.

The switch SW1 includes a control terminal 435 coupled to an output 421 of delay control circuit 420. The fault detection circuit 410 includes terminals 411 and 412. VIN is coupled to terminal 411 and VOUT is coupled to terminal 412. The fault detection circuit 410 monitors the voltage levels of VIN and VOUT and generates a fault flag (FF)

signal 415 on its output 414. The output 414 of the fault detection circuit 410 is coupled to an input 418 of the delay control circuit 420. The FF signal 415 is forced to a first logic state by the fault detection circuit 410 when neither VIN is below a threshold voltage level nor VOUT is below a threshold voltage level (the two threshold voltage levels may or may not be the same voltage level). When either or both VIN or VOUT drops below its corresponding threshold voltage level, the fault detection circuit 410 responds by asserting the FF signal 415 to a second logic state. The first logic state (neither VIN nor VOUT is below its threshold) may be logic low (0) and the second logic state (VIN or VOUT dropping below its threshold) may be logic high (1). In other implementations, the first logic state may be logic high (1) and the second logic state may be logic low (0).

In an example, the threshold voltage level to which VIN is compared is greater than the UVLO threshold implemented by the UVLO and EN logic 160 but below the minimum nominal level of VIN (i.e., the target regulated level for VOUT plus the drop-out voltage of the voltage regulator). In the numerical example described above, the UVLO threshold is 1.6 V, the drop-out voltage is 100 mV, the regulated level of VOUT is 5 V, and thus the threshold voltage level to which VIN is compared within the fault detection circuit 410 is greater than 1.6 V but less than 5.1 V. The threshold voltage level to which VOUT is compared is less than its regulated level. In one example, the threshold voltage level to which VOUT is compared is a value that is 50% of the regulated level for VOUT, but can have a value other than 0.5×VOUT.

As will be explained below, the delay control circuit 420 delays a deassertion of the FF signal 415. For example, if the FF signal 415 is normally logic low and is asserted high when either or both of VIN or VOUT drops below their respective threshold voltage level, the initial transition of the FF signal 415 from low to high is not delayed by the delay control circuit 420. However, when the fault condition terminates (e.g., VIN and VOUT returning to levels above their respective threshold voltages), the FF signal 415 transitions from the active fault state (logic high) back to logic low. This latter falling edge of the FF signal 415 is delayed by the delay control circuit 420. Accordingly, the output signal 425 (labeled as FF_DLY) generated by the delay control circuit 420 on its output 421 has a rising edge generally coincident with the initial rising edge of the FF signal 415 from the fault detection circuit, but has a falling edge that delayed from the falling edge of the FF signal 415. The additional delay implemented by the delay control circuit 420 maintains switch SW1 ON (closed) even after completion of the brown-out event to ensure proper recovery of filtered reference VREF.

The FF_DLY signal 425 is provided to the control input 435 of switch SW1. With FF_DLY signal 425 at a logic low level, the switch SW1 will be off (open). With FF_DLY signal 425 at a logic high level, the switch SW1 will be on (closed). As noted above, the logic polarity of the FF signal 415 can be the opposite from that described above. In general, switch SW1 is maintained in an off state when both VIN and VOUT are above their respective reference voltage levels, and switch SW1 is closed when either or both of VIN or VOUT have fallen below their respective reference voltage levels. Accordingly, when a VIN or VOUT fault occurs (VIN dropping below its nominal value of VOUT plus the drop-out voltage, or VOUT dropping below its threshold potentially indicating VOUT being shorted to ground), the FF signal 415 is asserted which, through the delay control circuit 420 causes switch SW1 to close. Closing SW1 causes a decrease in the time constant of the programmable filter 430 thereby permitting a much faster recovery of VOUT following cessation of the VIN or VOUT fault condition.

Figure 5:
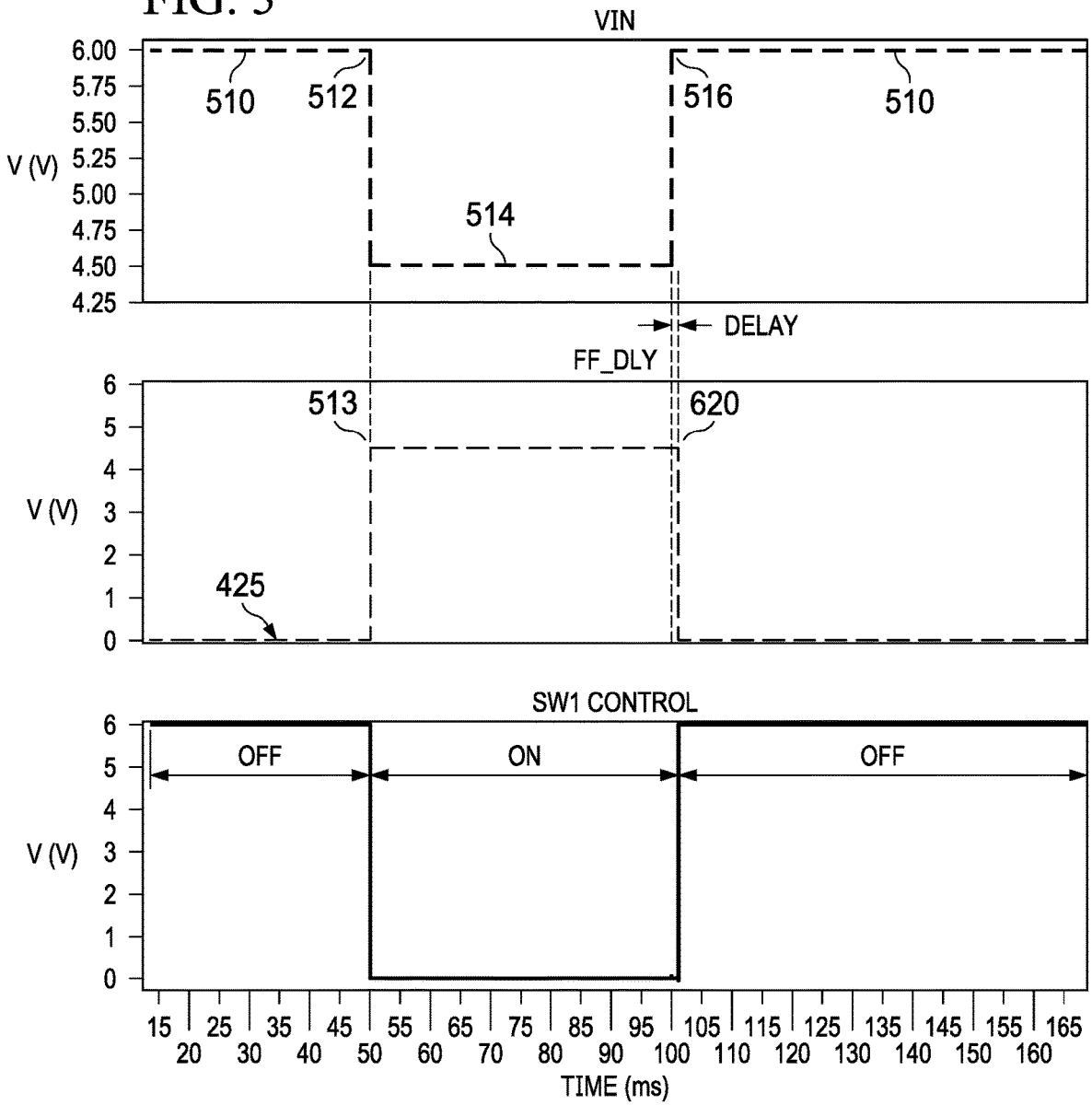
FIG. 5 is an illustrative timing diagram showing the behavior of the voltage regulator of FIG. 4 responsive to an input voltage fault condition (e.g., a brown-out event).

FIG. 5 is a timing diagram illustrating the behavior of the FF_DLY signal 425 and the on and off state of switch SW1 responsive to a brown-out event regarding VIN. VIN is at its nominal level 510 and a brown-out event occurs at 512 at which VIN drops to a lower level 514 (too low for the voltage regulator to regulate VOUT but high enough so as not to trigger an UVLO event). VIN falling to level 514 causes the FF signal 415 to be asserted high at 513 and thus FF_DLY to be asserted high as well. Switch SW1 had been in its off state before the brown-out event began but is caused to be on during the brown-out event as shown. The brown-out event ends at 516 at which time VIN returns to its nominal level 510. The FF signal 415 also transitions back to its logic low state at that time, but FF_DLY transitions to logic low (as identified at 620) after a delay (DELAY) implemented by the delay control circuit 420. Switch SW1 is turned off following the delay of the falling edge of the FF signal 415 (i.e., coincident with the falling edge of FF_DLY. As explained above, this additional delay (DELAY) keeps switch SW1 in ON stage even after completion of brown-out event to ensure proper recovery of filtered reference VREF.

Figure 6:
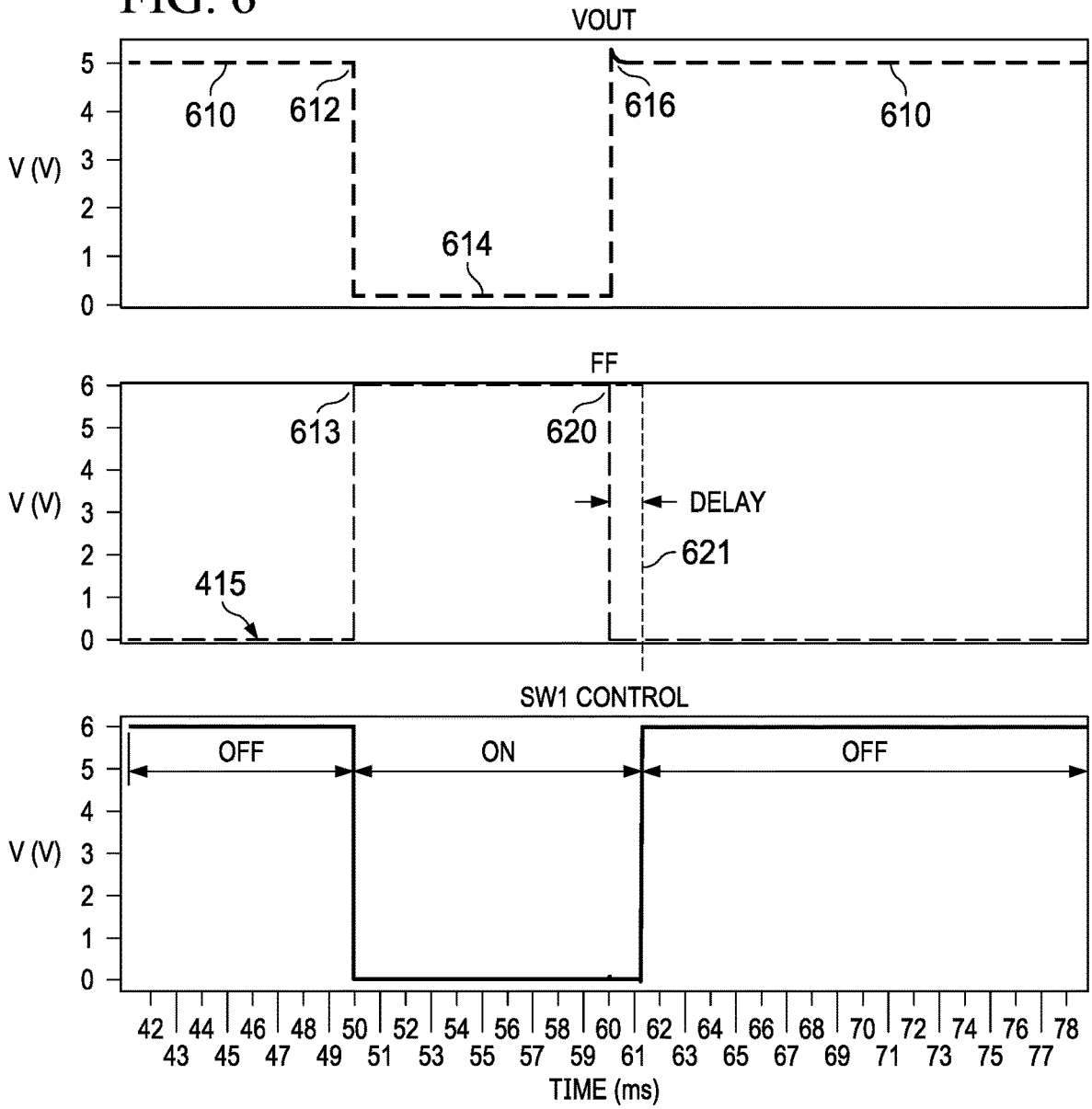
FIG. 6 is an illustrative timing diagram showing the behavior of the voltage regulator of FIG. 4 responsive to an output voltage fault condition.

FIG. 6 is a timing diagram illustrating the behavior of the FF signal 415 and the on and off state of switch SW1 responsive to a substantial decrease in VOUT (e.g., a short to ground). VOUT is at its nominal level 610 and the decrease in VOUT occurs at 612 at which VOUT drops to a lower level 614 (e.g., approximately 0 V). VOUT falling to level 614 causes the FF signal 415 to be asserted high at 613 (and thus FF_DLY (425) to be asserted high as well). Switch SW1 had been in its off state before the VOUT drop began but is caused to be on while VOUT is pulled low as shown. The VOUT fault event ends at 616 at which time VOUT returns to its nominal level 610. The FF signal 415 also transitions back to its high state at the same time (620), but (as indicated at 621 and the dashed line) FF_DLY transitions back to logic low after a delay (DELAY) implemented by the delay control circuit 420. Switch SW1 is turned off following the delay of the falling edge of the FF signal 415.

Figure 7:
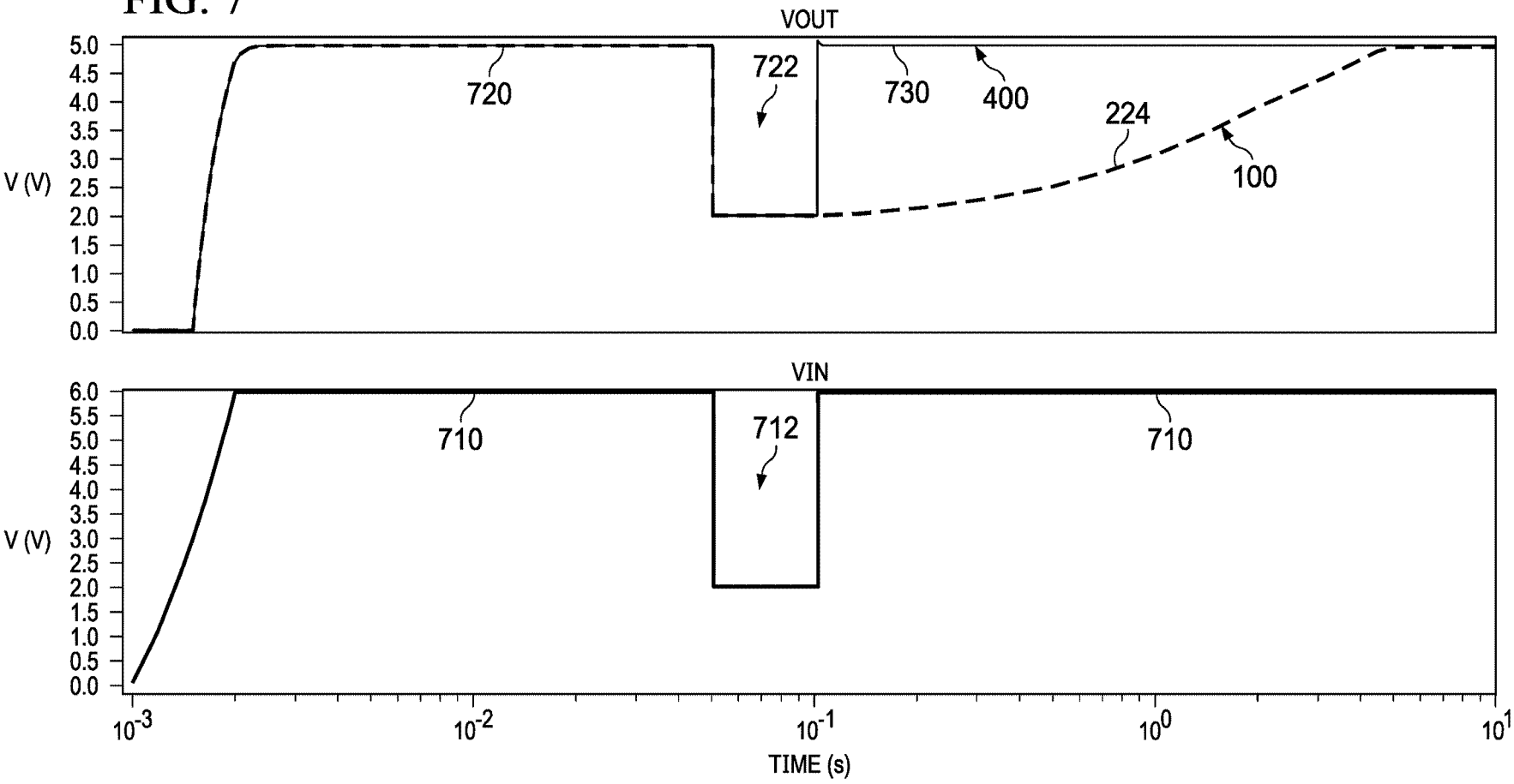
FIG. 7 compares the recovery of the output voltage of the voltage regulators of FIGS. 1 and 4 from cessation of an input voltage fault condition.

FIG. 7 compares the response of VOUT between the voltage regulators 100 and 400 following cessation of a VIN fault condition (e.g., brown-out event). As shown VIN and VOUT are at nominal levels 710 and 720, respectively (e.g., VIN equals 6 V and VOUT equals 5 V). A VIN fault condition (brown-out) occurs at 712. While VIN is at the lower voltage level, VOUT also is pulled low at 722 as explained above (and shown in FIG. 2). Whereas for the voltage regulator 100 of FIG. 1, VOUT recovers relatively slowly as shown at 224 (repeated from FIG. 2), for the voltage regulator 400, VOUT recovers much more quickly as shown at 730. Because switch SW1 is closed during the VIN fault condition at 722, the time constant for the filter is much shorter thereby causing VREF and thus VOUT to recover much quicker.

Figure 8:
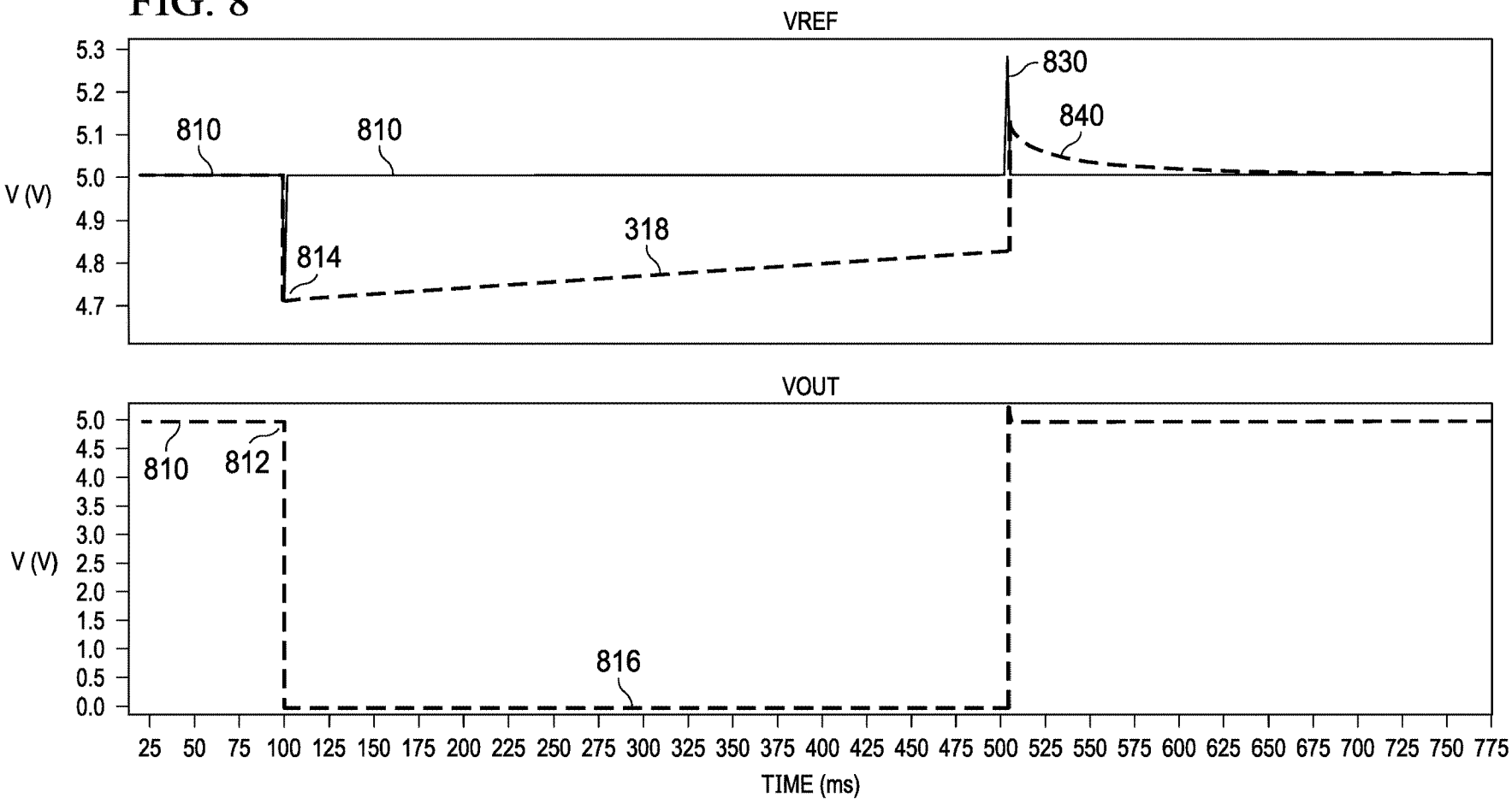
FIG. 8 compares the recovery of the filtered reference voltage of the voltage regulators of FIGS. 1 and 4 from cessation of an output voltage fault condition.

FIG. 8 compares the response of VREF (filtered reference voltage) between the voltage regulators 100 and 400 following cessation of a VOUT fault condition (e.g., VOUT being shorted to ground). As shown VOUT and VREF are at nominal levels 810 and 820, respectively (e.g., 5 V). A VOUT fault begins at 812. While VOUT is at the lower voltage level (identified at 816), VREF also is forced to a lower level low as shown at 814. Whereas for the voltage regulator 100 of FIG. 1, VREF ramps relatively slowly as shown at 318 (repeated from FIG. 3), for the voltage regulator 400, VREF also dips down at 814 but then jumps back to level 810 much more quickly as shown. Because switch SW1 is closed during the VOUT fault condition at 722, the time constant for the filter is much shorter thereby causing VREF to recover much quicker. Similarly, VREF recovers much faster at 830 with the voltage regulator 400 than for voltage regulator 100 (as indicated by 840)

Figure 9:
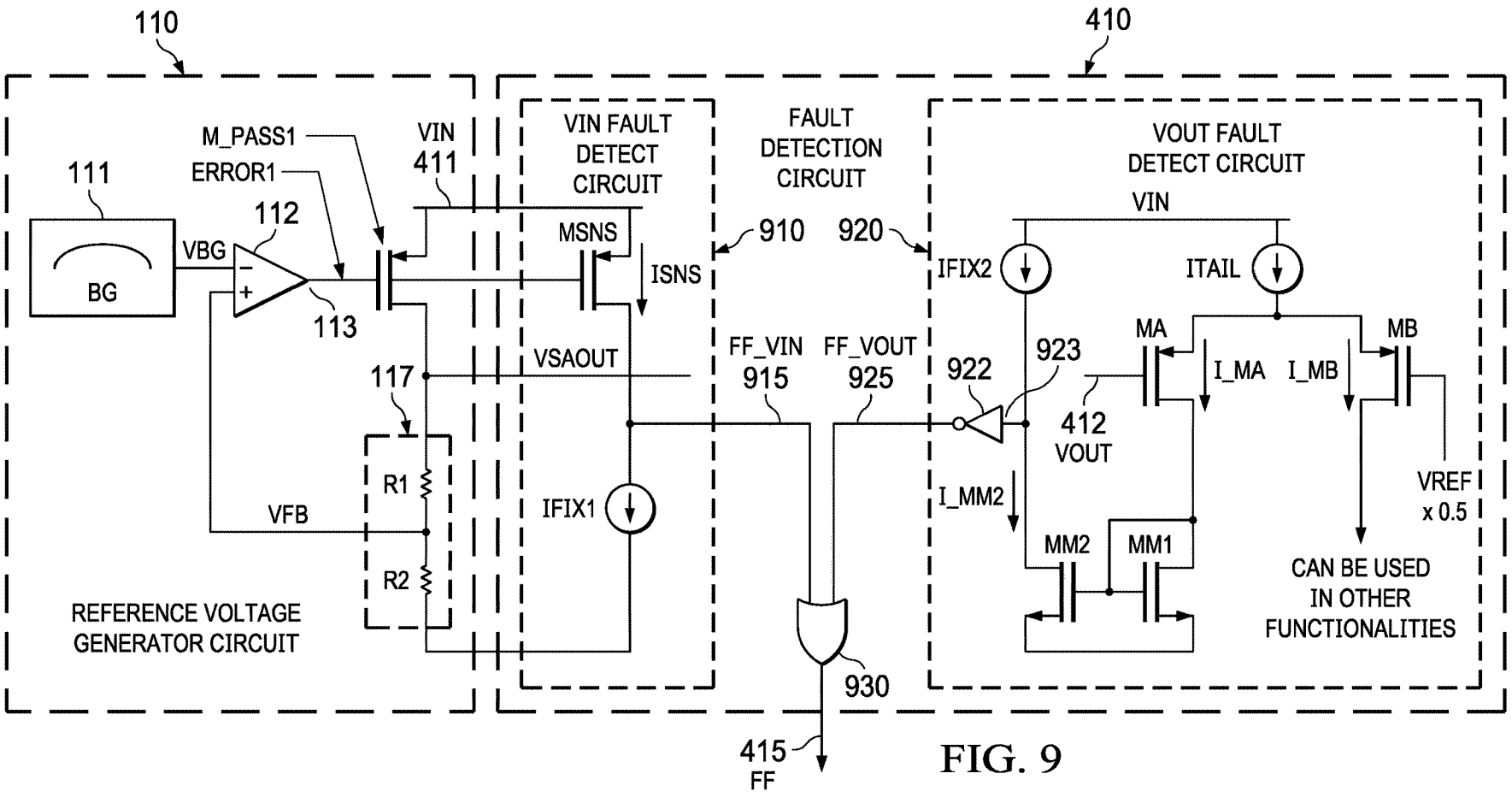
FIG. 9 shows an illustrative implementation of the fault detection circuit of FIG. 4.

FIG. 9 shows an example implementation of fault detection circuit 410. In this example, the fault detection circuit 410 includes a VIN fault detect circuit 910, a VOUT fault detect circuit 920, and an OR gate 930. The VIN fault detect circuit 910 detects when VIN falls below a threshold, and responsive that occurrence, asserts FF_VIN signal 915 high. Similarly, the VOUT fault detect circuit 920 detects when VOUT falls below a threshold, and responsive that occurrence, asserts FF_VOUT signal 925 high. OR gate 930 receives both the FF_VIN signal 915 and the FF_VOUT signal 925 and produces the FF signal 415 described above. In other implementations, the OR gate 930 can be replaced with another logic gate, collection of logic gates, or other type of circuit to produce a unified FF signal 415 based on the assertion of either or both of the FF_VIN or FF_VOUT signals 915, 925.

The VIN fault detect circuit 910 comprises a transistor coupled to M_PASS1 in a configuration to sense the drain current through M_PASS1, and accordingly is referred to as a sense transistor, MSNS. That is, the gate of MSNS is coupled to the gate of M_PASS1 and the source of MSNS is coupled to the source of M_PASS1 at terminal 411 (VIN). The size of MSNS (e.g., the ratio of its channel width (W) to its channel length (L)) may be the same or smaller than the size of M_PASS1. In any event, the drain current (ISNS) through MSNS is generally a function of the drain current through M_PASS1. The drain of MSNS is coupled to a current source IFIX1 (IFIX1 refers both to the current source device/circuit as well as to the current through the current source).

Figure 10:
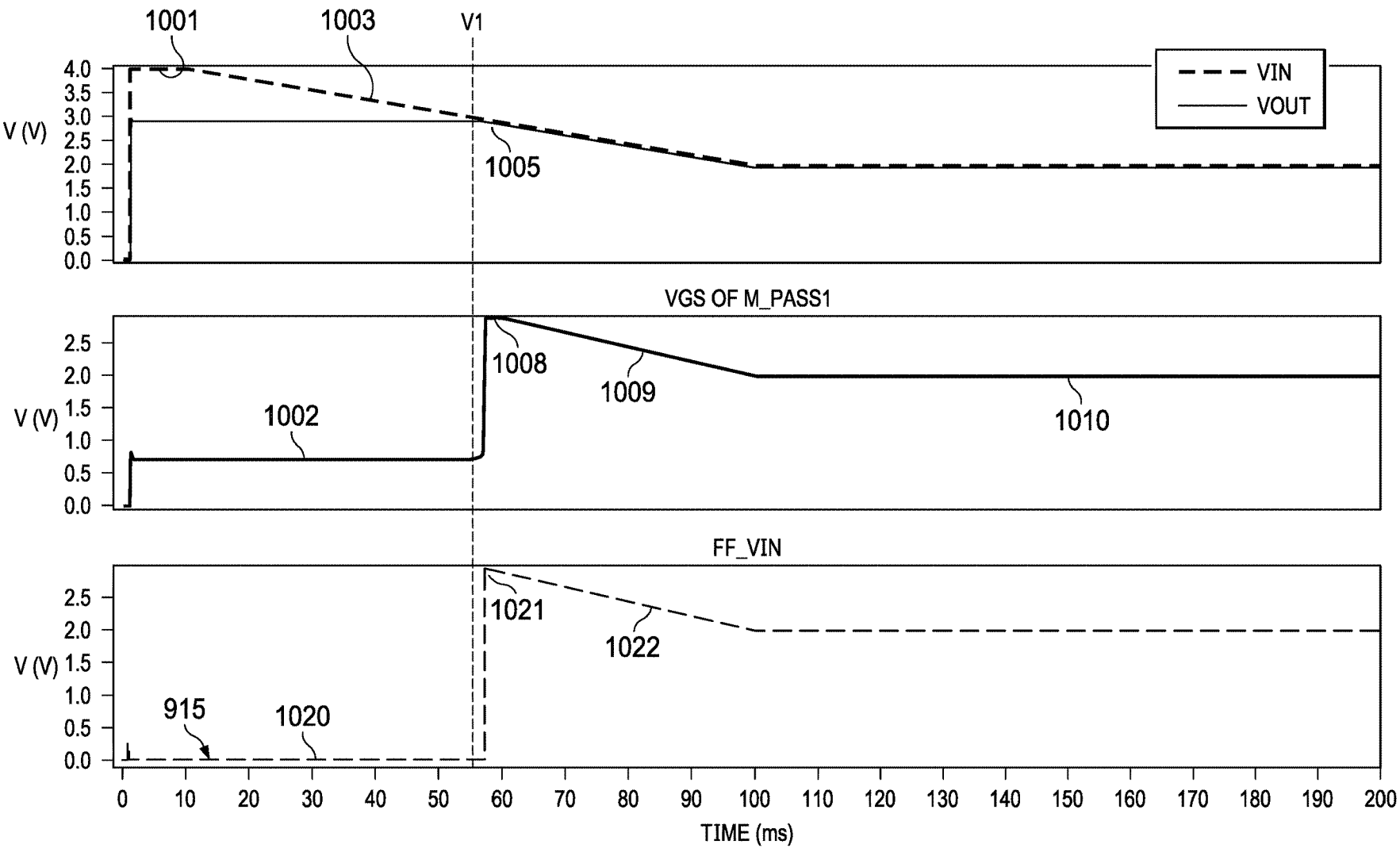
FIG. 10 is an example timing diagram illustrating the fault detection circuit response to a reduction in the input voltage below a threshold.

FIG. 10 is a timing diagram illustrating the behavior of the VIN fault detect circuit 910. Referring still to FIG. 9 and the timing diagram of FIG. 10, during normal operation in which, as identified by reference numeral 1001 in FIG. 10, VIN is within its nominal range (above VOUT plus the drop-out voltage of the regulator), the current ISNS is a function of the current through M_PASS1. The VGS for transistor M_PASS1 is relatively low as shown at 1002. VIN may decrease as identified by numeral 1003. If VIN were to drop below the regulated level of VOUT plus the drop-out voltage (as identified at reference numeral 1005), the error amplifier 112 will reduce the voltage of ERROR1 (larger VGS as shown at 1008) to thereby fully enhance transistor M_PASS1. With M_PASS1's VGS at level 1008, transistor M_PASS1 will be fully enhanced, and thus the drain current M_PASS1 will increase thereby causing an increase in ISNS. FF_VIN 915 is logic low (reference numeral 915) as long as ISNS is smaller than IFIX1. When ISNS, however, exceeds IFIX1, the VDS of MSNS will decrease thereby causing FF_VIN 915 to become logic high (reference numeral 1021). Accordingly, FF_VIN 915 being asserted high is indicative of VIN being below a threshold voltage level. IFIX1 is configured to be a fixed current to thereby cause FF_VIN 915 to go high when VIN drops below a target threshold. As VIN continues to decrease, the VGS of transistor M_PASS1 will also decrease as identified at 1000 and FF_VIN also will decrease (1022) but remain at a logic high level Referring to FIG. 9, the VOUT fault detect circuit 920 includes a current sources ITAIL and IFIX2 (ITAIL and IFIX2 refer to both the current sources as well as the currents), transistors MA, MB, MM1, and MM2, and inverter 922. Transistors MA and MB are shown as p-type metal oxide field effect transistors (PFET transistors) in FIG. 9 and transistors MM1 and MM2 are shown as n-type metal oxide field effect transistors (NFET transistors). In other implementations, the transistors can be implemented with opposite doping profiles (e.g., MA and MB as NFET transistors and MM1 and MM2 as PFET transistors). The sources of MA and MB are coupled together and to VIN. The gate of transistor MA is driven by VOUT and the gate of transistor MB is driven by a voltage that is a function of VREF (e.g., 0.5×VREF).

Transistors MM1 and MM2 form a current mirror (mirror ratio equal to 1 or a ratio other than 1). The drain of transistor MA is coupled to the drain of transistor MM1. Current source IFIX 2 is coupled between VIN and the drain of transistor MM2. The input 923 of inverter 922 is coupled to the drain of transistor MM2. The output of inverter 922 is coupled to an input of OR gate 930.

Figure 11:
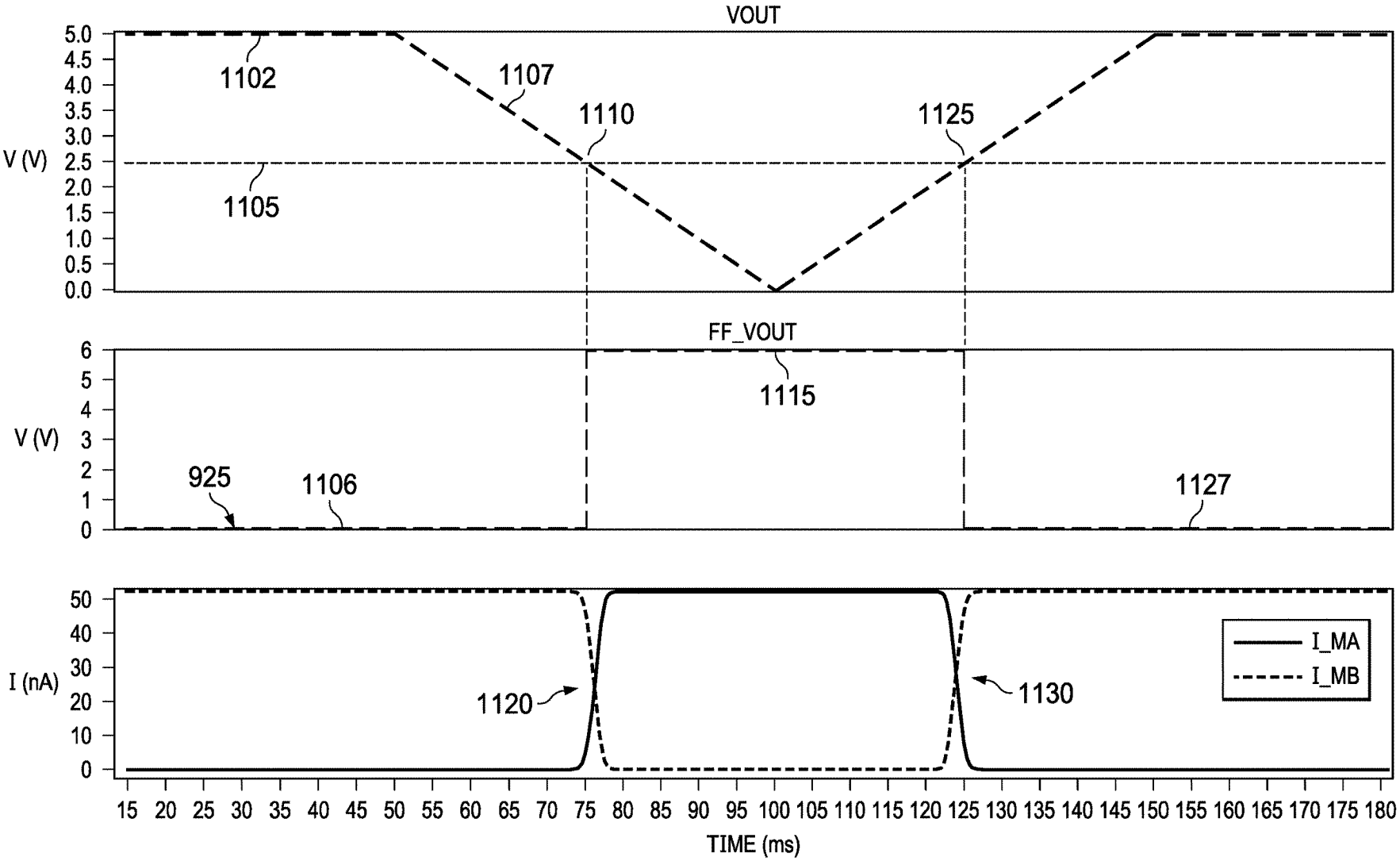
FIG. 11 is an example timing diagram illustrating the fault detection circuit response to a reduction in the output voltage below a threshold.

FIG. 11 is a timing diagram illustrating the behavior of the VOUT fault detect circuit 920. Referring still to FIG. 9 and the timing diagram of FIG. 11, the voltage on the drain of transistor MM2 is normally high (when VOUT is at its regulated voltage level as identified by reference numeral 1102). Due to inverter 922, the FF_VOUT signal 925 is logic low as shown at 1106. The tail current from current source ITAIL divides between transistors and MA and MB based on the relative magnitudes of their VGS voltages. The current through transistor MA is I_MA and the current through transistor MB is I_MB. The VGS voltage of transistor MB is fixed but the gate voltage of transistor MA will decrease if VOUT decreases. As VOUT decreases as identified at 1107 from its regulated level identified at 1102, the VGS of transistor MA increases and thus as identified by reference numeral 1120 more of the tail current ITAIL begins to flow through transistor MA to transistor MM1 of the current mirror. As the current through transistor MM1 increases, the current (I_MM2) through transistor MM2 also increases. When I_MM2 exceeds IFIX2, the voltage on the drain of transistor becomes low enough so as to trigger the inverter 922 to force its output (and thus FF_VOUT 925) to a logic high state as illustrated at reference numeral 1115. As VOUT recovers and exceeds the regulated voltage level as illustrated at reference numeral 1125, the relative magnitudes of currents I_MA and I_MB again switch and FF_VOUT signal 925 switches back to a logic low state (1127).

Figure 12:
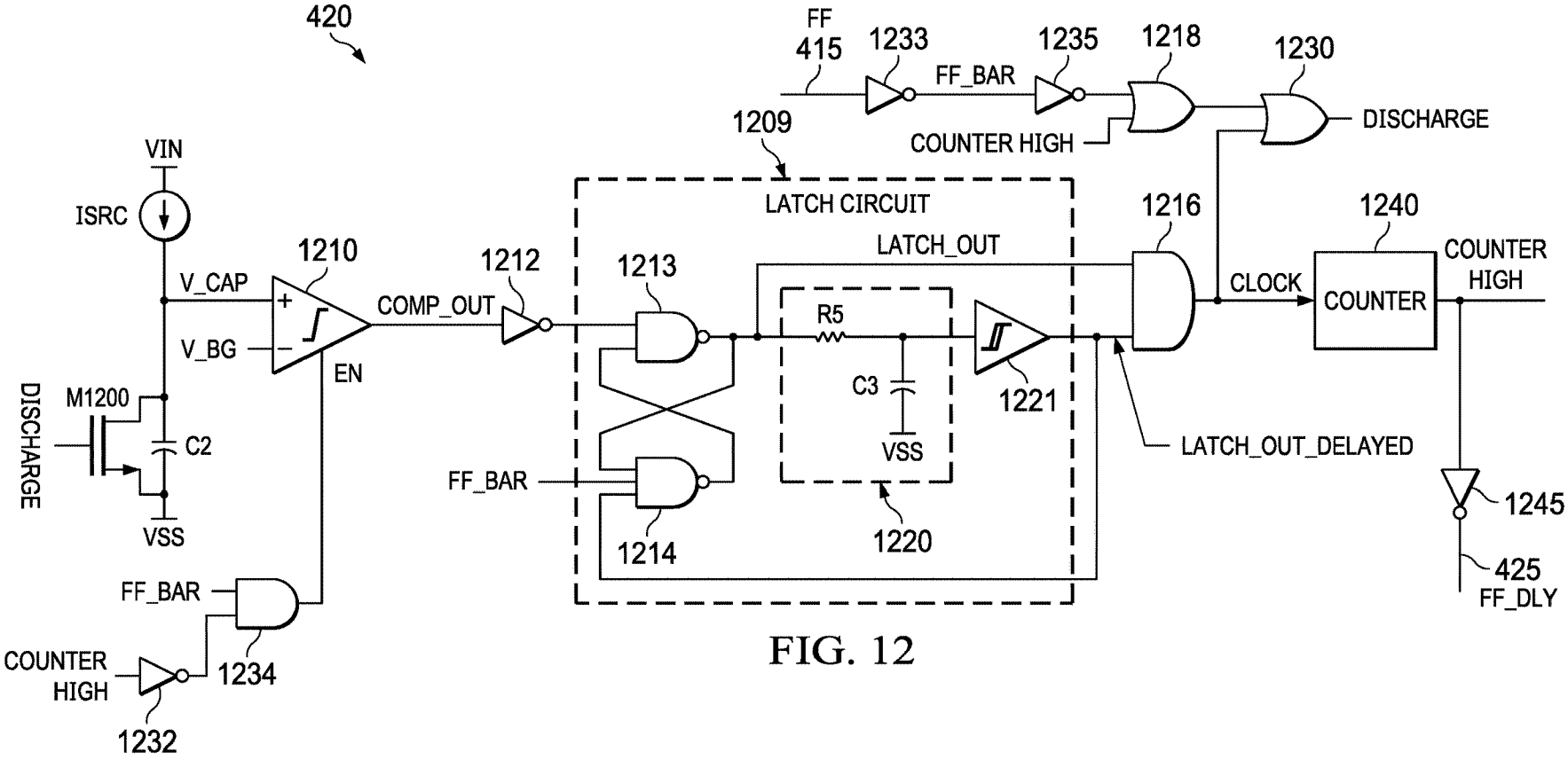
FIG. 12 shows an illustrative implementation of the delay control circuit of FIG. 4.

FIG. 12 provides an example implementation of the delay control circuit 420. The FF signal 415 is coupled through a pair of inverters 1233 and 1235 to an input of an OR gate 1218. The output signal form inverter 1233 is the logical inverse of FF and is shown in FIG. 12 as FF_BAR. The delay control circuit 420 in the example of FIG. 4 includes a transistor M1200 coupled across a capacitor C2. A current source ISRC is coupled to capacitor C2. Current (also referred to as ISRC) from the current source is used to charge capacitor C2 when transistor M1200 is off. The on and off state of transistor M1200 is controlled by DISCHARGE, which is the output signal from OR gate 1230. When transistor M1200 is off (DISCHARGE is low), the current source ISRC provides charge current to capacitor C2 causing V_CAP (the voltage across the capacitor) to ramp up. When transistor M1200 is on (DISCHARGE is high), capacitor C2 discharges through transistor M1200 to ground. The delay control circuit 420 includes a comparator 1210 having a positive (+) input and a negative input (−). The V_CAP voltage from the capacitor C2 is coupled to the positive input of the comparator 1210 and a bandgap voltage V_BG is coupled to the negative input. As V_CAP ramps up (which occurs when transistor M1200 is off), the output signal of comparator 1210 (a signal called COMP_OUT) becomes logic high when V_CAP exceeds V_BG. COMP_OUT is provided to, and inverted by, inverter 1212.

The output of the inverter 1212 is coupled to a latch circuit 1209. The latch circuit 1209 includes NAND gates 1213 and 1214, a delay element 1220 (e.g., resistor R5 coupled to capacitor C3 as shown), and a Schmitt trigger 1221. The output of the latch circuit 1209 comprises a signal called LATCH_OUT generated on the output of NAND gate 1213 and a signal (LATCH_OUT_DELAYED) generated on the output of the Schmitt trigger 1221. The LATCH_OUT_DELAYED signal is a delayed and inverted (by Schmitt trigger 1221) tversion of LATCH_OUT, with the amount of time delay being a function of the time constant formed by the combination of resistor R5 and capacitor C3. In one example, the amount of delay of between a rising edge of LATCH_OUT and the corresponding falling edge of LATCH_OUT_DELAY is 125 ns. Signal FF_BAR is provided to an input of NAND gate 1214, and functions to reset latch circuit 1209.

LATCH_OUT and LATCH_OUT_DELAYED are provided to inputs of an AND gate 1216. The output signal from AND gate 1216 is a clock signal (CLOCK) which is coupled to an input of a counter 1240 and to an input of an OR gate 1230. CLOCK is asserted high by AND gate 1216 when both LATCH_OUT and LATCH_OUT_DELAY are simultaneously high. The output signal of the counter 1240 (COUNTER HIGH) is provided to an input of an inverter 1245, and the output signal from inverter 1245 is FF_DLY. The counter 1240 is configured to count a prescribed number of pulses of CLOCK (e.g., rising edges). In one implementation, the counter 1240 is configured to count 32 pulses of CLOCK in order for it to transition its output signal, COUNTER HIGH, from a logic low state to a logic high state. When the counter 1240 reaches its terminal count, COUNTER_HIGH transitions to logic high and FF_DLY 425 transitions to logic low.

In addition to receiving the FF 415 signal through inverters 1233 and 1235 (FF 415 slightly delayed by the propagation delay of inverters 1233 and 1235), the OR gate 1218 also receives COUNTER HIGH on another input. The output of OR gate 1218 is coupled to an input of OR gate 1230, the output of which is the DISCHARGE signal as noted above.

The delay control circuit 420 also includes an inverter 1232 and an AND gate 1234. COUNTER HIGH is provided to the input of inverter 1232, the output of which is coupled to an input of AND gate 1234. The FF_BAR signal is provided to another input of AND gate 1234. The output of AND gate 1234 is coupled to enable (EN) input of comparator 1210. Driving the EN input of the comparator 1210 high enables the comparator and forcing the EN input low disables the comparator. When the counter 1240 reaches its terminal count, COUNTER_HIGH becomes logic high, which through inverter 1232, causes the output of AND gate 1234 to become logic low thereby disabling the comparator 1210. Accordingly, when the counter 1240 reaches its terminal count, DISCHARGE is asserted high through OR gate 1230 which causes V_CAP to be pulled low, and the comparator 1210 is disabled.

Figure 13:
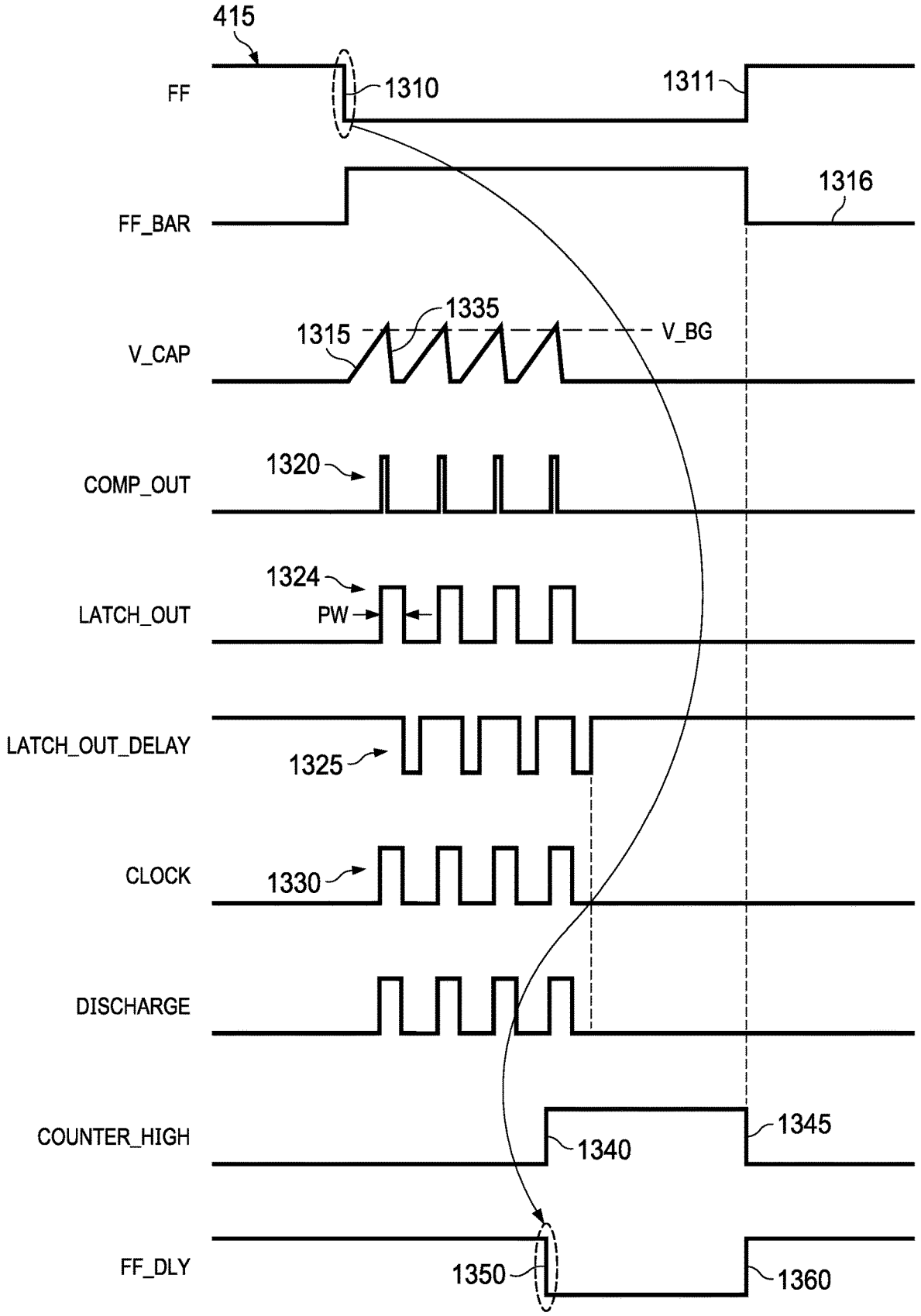
FIG. 13 is a timing diagram illustrating the operation of the delay control circuit of FIG. 12.

FIG. 13 provides a timing diagram illustrating the behavior of the delay control circuit 420. Referring to both FIGS. 12 and 13, the FF signal 415 is shown as including a falling edge 1310 and a rising edge 1311. Falling edge 1310 occurs upon the cessation of a previously detected fault condition (and thus VIN and VOUT being above their respective threshold voltages) and rising edge 1311 occurs responsive to the detection of a subsequent fault condition (VIN and/or VOUT falling below their respective threshold voltages). FF_BAR is shown as being the logical inverse of FF 415.

DISCHARGE is initially low which causes transistor M1200 to be off thereby permitting V_CAP to ramp up as shown at 1315. When V_CAP reaches the level of the bandgap reference voltage (V_BG), COMP_OUT becomes logic high as shown at 1320. Each pulse of COMP_OUT causes the latch circuit 1209 to generate a wider pulse 1324 for LATCH_OUT (the pulse width (PW) of which is a function of the RC time constant of resistor R5 and capacitor C3). LATCH_OUT_DELAY comprises a corresponding negative pulse 1325 delayed form the positive pulse 1324 of LATCH_OUT (delayed by PW).

When both LATCH_OUT and LATCH_OUT_DELAY are both simultaneously high, AND gate 1216 forces CLOCK high as shown at 1330. Once CLOCK becomes high, OR gate 1230 forces DISCHARGE high, which causes transistor M1200 to turn on thereby discharging capacitor C2 and, as shown at 1335, pulling V_CAP low. When a CLOCK pulse ends, DISCHARGE is again forced low, which turns off transistor M1200 and the process repeats.

Counter 1240 counts the preconfigured number of pulses (four in the example of FIG. 13, but can be other than four clock pulses in other examples). Once the counter 1240 reaches its terminal count, COUNTER_HIGH becomes logic high as indicated by rising edge 1340. FF_DLY 425 has a falling edge 1350 due to inverter 1245. FIG. 13 illustrates that, through the operation of the comparator 1210, latch circuit 1209, and counter 1240, falling edge 1310 of FF 415 (end of the previous fault condition) causes a corresponding delayed falling edge 1350 of FF_DLY 425.

Upon the subsequent rising edge 1311 of FF 415, COUNTER HIGH transitions from high to low as indicated by falling edge 1345. While FF 415 is high, FF_BAR is low as shown at 1316, Due to inverter 1245, FF_DLY has a falling edge (1360). Accordingly, upon FF 415 becoming high, there is little or no delay for the corresponding rising edge 1360 of FF_DLY 425.

The example voltage regulator of FIG. 4 includes the delay control circuit 420. In other examples, a delay control circuit is not present and the output of the fault detection circuit 410 is coupled to the control input 435 of switch SW1. The gain of the regulation loop 150 is unity gain, but the gain can be other than 1 in other examples (e.g., greater than 1).

In this description, the term "couple" may cover connections, communications, or signal paths that enable a functional relationship consistent with this description. For example, if device A generates a signal to control device B to perform an action: (a) in a first example, device A is coupled to device B by direct connection; or (b) in a second example, device A is coupled to device B through intervening component C if intervening component C does not alter the functional relationship between device A and device B, such that device B is controlled by device A via the control signal generated by device A.

Modifications are possible in the described embodiments, and other embodiments are possible, within the scope of the claims.

What is claimed is:

1. A voltage regulator circuit, comprising:

a reference voltage generator circuit having a reference output;

a regulation loop circuit having an input voltage terminal, an output voltage terminal, and a reference terminal, the regulation loop circuit configured to provide a first voltage at the output voltage terminal responsive to: a second voltage at the input voltage terminal; and a difference between a reference voltage at the reference terminal and the first voltage;

a detection circuit having a detection input and a detection output, the detection input coupled to the output voltage terminal and configured to provide a control signal at the detection output responsive to the first voltage; and a filter circuit having a filter input, a filter control input, and a filter output, the filter input coupled to the reference output, the filter control input coupled to the detection output, the filter output coupled to the reference terminal, and the filter circuit having a time constant configurable responsive to the control signal at the filter control input.

2. The voltage regulator circuit of claim 1, wherein the filter circuit includes:

a capacitor coupled to the filter output;

a first resistor coupled between the filter input and the filter output; and a switch and a second resistor coupled in series between the filter input and the filter output.

3. The voltage regulator circuit of claim 2, wherein the switch has a switch control terminal coupled to the filter control input.

4. The voltage regulator circuit of claim 3, wherein:

the detection circuit is a first detection circuit;

the detection output is a first detection output;

the control signal is a first control signal;

the filter control input is a first filter control input;

the filter circuit has a second filter control input;

the first detection circuit has a second detection input coupled to the input voltage terminal and is configured to set a state of the first control signal responsive to whether the second voltage is below a first threshold; and the voltage regulator circuit further comprises a second detection circuit having a third detection input and a second detection output, the third detection input coupled to the input voltage terminal, the second detection output coupled to the second filter control input, and the second detection circuit configured to set a state of a second control signal at the second detection output responsive to whether the second voltage is below a second threshold, in which the second threshold is lower than the first threshold; and the first resistor includes a resistor control terminal coupled to the second filter control input, in which the first resistor has a resistance configurable responsive to a state of the resistor control terminal.

5. The voltage regulator circuit of claim 4, wherein:

the second detection circuit has a fourth detection input coupled to an enable terminal;

the voltage regulator circuit is enabled or disabled responsive to a state of the enable terminal; and the second detection circuit is configured to set a state of the second control signal responsive to the state of the enable terminal.

6. The voltage regulator circuit of claim 1, further including a delay circuit having a delay input and a delay output, the delay input coupled to the detection output, and the delay output coupled to the filter control input.

7. The voltage regulator circuit of claim 6, wherein the delay circuit is configured to delay one of a rising edge or a falling edge of the control signal.

8. A voltage regulator circuit, comprising:

a reference voltage generator circuit having a reference output;

a regulation loop circuit having an input voltage terminal, an output voltage terminal, and a reference terminal, the regulation loop circuit configured to provide a first voltage at the output voltage terminal responsive to: a second voltage at the input voltage terminal; and a difference between a reference voltage at the reference terminal and the first voltage;

a first detection circuit having a first detection input and a first detection output, the first detection input coupled to the input voltage terminal and configured to provide a first control signal at the first detection output responsive to whether the second voltage is below a first threshold;

a second detection circuit having a second detection input and a second detection output, the second detection input coupled to the input voltage terminal and configured to provide a second control signal at the second detection output responsive to whether the second voltage is below a second threshold; and a filter circuit having a filter input, a first filter control input, a second filter control input, and a filter output, the filter input coupled to the reference output the first filter control input coupled to the first detection output, the second filter control input coupled to the second detection output, and the filter output coupled to the reference terminal.

9. The voltage regulator circuit of claim 8, wherein:

the second detection circuit has a third detection input coupled to the output voltage terminal; and is configured to set a state of the second detection output responsive to at least one of: whether the first voltage is below a third threshold; or whether the second voltage is below the second threshold.

10. The voltage regulator circuit of claim 8, wherein the first threshold is smaller than the second threshold.

11. The voltage regulator circuit of claim 8, wherein the filter circuit includes:

a capacitor coupled to the filter output;

a first resistor coupled between the filter input and the filter output, the first resistor having a resistor control terminal coupled to the second filter control input, in which the first resistor has a resistance configurable responsive to a state of the resistor control terminal; and a switch and a second resistor coupled in series between the filter input and the filter output, the switch having a switch control terminal coupled to the first filter control input.

12. The voltage regulator circuit of claim 8, further including a delay circuit having a delay input and a delay output, the delay input coupled to the second detection output, and the delay output coupled to the second filter control input.

13. The voltage regulator circuit of claim 12, wherein the delay circuit is configured to delay one of a rising edge or a falling edge of the second control signal.

14. A voltage regulator circuit, comprising:

a reference voltage generator circuit having a reference output;

a regulation loop circuit having an input voltage terminal, an output voltage terminal, and a reference terminal, the regulation loop circuit configured to provide a first voltage at the output voltage terminal responsive to: a second voltage at the input voltage terminal; and a difference between a reference voltage at the reference terminal and the first voltage;

a detection circuit having a detection input and a detection output, the detection input coupled to the input voltage terminal and configured to provide a control signal at the detection output responsive to the second voltage; and a filter circuit having a filter input, a filter control input, and a filter output, the filter input coupled to the reference output, the filter control input coupled to the detection output, the filter output coupled to the reference terminal, and the filter circuit having a time constant configurable responsive to the control signal at the filter control input.

15. The voltage regulator circuit of claim 14, wherein the fault detection filter circuit includes:

a capacitor coupled to the filter output;

a first resistor coupled between the filter input and the filter output; and a switch and a second resistor coupled in series between the filter input and the filter output, the switch having a switch control terminal coupled to the filter control input.

16. The voltage regulator circuit of claim 14, further including a delay circuit having a delay input and a delay output, the delay input coupled to the detection output, and the delay output coupled to the filter control input.

17. The voltage regulator circuit of claim 16, wherein the delay circuit is configured to delay one of a rising edge or a falling edge of the control signal.

18. The voltage regulator circuit of claim 15, wherein:

the detection circuit is a first detection circuit;

the detection output is a first detection output;

the control signal is a first control signal;

the filter control input is a first filter control input;

the filter circuit has a second filter control input;

the first detection circuit is configured to set a state of the first control signal responsive to whether the second voltage is below a first threshold;

the voltage regulator circuit further comprises a second detection circuit having a second detection input and a second detection output, the second detection input coupled to the input voltage terminal, the second detection output coupled to the second filter control input, and the second detection circuit configured to set a state of a second control signal at the second detection output responsive to whether the second voltage is below a second threshold; and the first resistor includes a resistor control terminal coupled to the second filter control input, in which the first resistor has a resistance configurable responsive to a state of the resistor control terminal.

19. The voltage regulator circuit of claim 18, wherein the second threshold is below the first threshold.

20. The voltage regulator circuit of claim 14, wherein the regulation loop circuit includes:

an error amplifier having first and second inputs and an amplifier output, the first input coupled to the reference terminal, and the second input coupled to the output voltage terminal; and a transistor having first and second current terminals and a transistor control terminal, the first current terminal coupled to the input voltage terminal, the second current terminal coupled to the output voltage terminal, and the transistor control terminal coupled to the amplifier output.

21. The voltage regulator circuit of claim 14, wherein:

the detection input is a first detection input; and the detection circuit has a second detection input coupled to the output voltage terminal and is configured to set a state of the detection output responsive to at least one of: whether the first voltage is below a first threshold; or whether the second voltage is below a second threshold.

22. The voltage regulator circuit of claim 1, wherein:

the detection input is a first detection input; and the detection circuit has a second detection input coupled to the input voltage terminal and is configured to set a state of the detection output responsive to at least one of: whether the first voltage is below a first threshold; or whether the second voltage is below a second threshold.

* * * * *